US008042929B2

(12) United States Patent
Yokoyama

(10) Patent No.: US 8,042,929 B2
(45) Date of Patent: Oct. 25, 2011

(54) INK JET RECORDING APPARATUS

(75) Inventor: Takeshi Yokoyama, Tokyo (JP)

(73) Assignee: Konica Minolta Medical & Graphic, Inc. (JP)

( * ) Notice: Subject to any disclaimer, the term of this patent is extended or adjusted under 35 U.S.C. 154(b) by 845 days.

(21) Appl. No.: 11/858,500

(22) Filed: Sep. 20, 2007

(65) Prior Publication Data

US 2008/0068431 A1 Mar. 20, 2008

(30) Foreign Application Priority Data

Sep. 20, 2006 (JP) ..... 2006-254394

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 6,536,889 | B1 | 3/2003 | Biegelsen et al. | |
| 7,232,212 | B2 * | 6/2007 | Iwase | 347/102 |
| 7,264,346 | B2 * | 9/2007 | Nishino et al. | 347/102 |
| 7,682,015 | B2 * | 3/2010 | Hoshino | 347/102 |
| 7,744,207 | B2 | 6/2010 | Iwase | |
| 7,762,658 | B2 | 7/2010 | Iwase | |
| 7,794,075 | B2 * | 9/2010 | Nakano et al. | 347/102 |
| 2003/0081096 | A1 * | 5/2003 | Young | 347/102 |
| 2003/0184631 | A1 * | 10/2003 | Suzuki et al. | 347/102 |
| 2004/0036753 | A1 * | 2/2004 | Hirai | 347/102 |
| 2004/0241578 | A1 | 12/2004 | Hirai | |
| 2005/0099478 | A1 * | 5/2005 | Iwase | 347/102 |
| 2006/0087543 | A2 | 4/2006 | Iwase | |
| 2006/0209150 | A1 * | 9/2006 | Iwata | 347/102 |
| 2008/0170104 | A1 | 7/2008 | Iwase | |
| 2009/0021569 | A1 | 1/2009 | Iwase | |
| 2009/0207224 | A1 * | 8/2009 | Cofler | 347/102 |

FOREIGN PATENT DOCUMENTS

| | | | |
|---|---|---|---|
| EP | 1348566 | B1 | 10/2003 |
| EP | 1428668 | B1 | 6/2004 |
| JP | 6-200204 | | 7/1994 |
| JP | 2003-311945 | A | 11/2003 |
| JP | 2004-034667 | A | 2/2004 |
| JP | 2004-188864 | | 7/2004 |
| JP | 2004-314478 | A | 11/2004 |
| JP | 2004-359715 | A | 12/2004 |
| JP | 2005-144679 | A | 6/2005 |
| JP | 2006-181805 | A | 7/2006 |
| WO | 2005/068509 | A1 | 7/2005 |

OTHER PUBLICATIONS

Extended European Search Report for Application No./Patent No. 07253710.3-1251/1958778 dated Sep. 3, 2010. Japanese Office Action, Notification of Reasons for Refusal for Japanese Patent Application No. 2006-254394 mailing date of May 10, 2011 with English Translation.

* cited by examiner

*Primary Examiner* — Charlie Peng
(74) *Attorney, Agent, or Firm* — Cantor Colburn LLP

(57) ABSTRACT

Disclosed an ink jet recording apparatus for recording images in a recording medium having an ink absorbability, including: a recording head including a nozzle for jetting a photocurable ink onto the recording medium; and a light irradiation device to apply light to the photocurable ink landed on the recording medium, wherein: the light irradiation device includes a first light source to emit light having a first emission spectrum, and a second light source to emit light having a second emission spectrum whose peak wavelength is shorter than a peak wavelength of the first emission spectrum, and the first and second light sources are arranged so that the first light source irradiates the photocurable ink landed on the recording medium and thereafter the second light source irradiates the photocurable ink.

4 Claims, 5 Drawing Sheets

INK JET RECORDING APPARATUS

BACKGROUND

1. Field of the Invention

The present invention relates to an ink jet recording apparatus, and more particularly to an ink jet recording apparatus for recording images in a recording medium having an ink absorbability such as paper or fabric.

2. Description of Related Art

As an image recording apparatus capable of recording images not only in a normal recording medium such as paper or fabric but also a recording medium of low ink absorbability such as a resin film or a metal, an ink jet recording apparatus that jets an ink from a nozzle disposed in one end surface of a recording head so that the ink lands on the recording medium has been developed, and this technique is applied in various technical fields at present. Among them, a photocurable ink jet recording apparatus that applies light such as ultraviolet rays to the ink landed on the recording medium so as to harden and fix the ink has actively been developed as a recording apparatus which enables easy acquisition of high-definition images (e.g., Japanese Patent Application Laid-Open No. 2004-188864 and Japanese Patent Application Laid-Open No. Hei 6-200204).

As such an ink jet recording apparatus, in Japanese Patent Application Laid-Open No. 2004-188864, the applicant of the present invention discloses a technique of an ink jet recording apparatus which includes a plurality of ultraviolet-ray sources different in a peak wavelength of emitted light as main sensitivity wavelengths of inks of various colors such as yellow (Y), magenta (M), cyan (C) and black (K) jetted from a recording head vary from ink to ink. Especially it is disclosed an ink-jet apparatus where an ultraviolet-ray source having a shorter peak wavelength of emitted light is positioned closer to the recording head, so that ultraviolet rays of longer wavelengths is applied after application of an ultraviolet ray of a shorter wavelength to the ink landed on the recording medium.

The ink jet recoding apparatus described in Japanese Patent Application Laid-Open No. 2004-188864 is useful especially when an image is recorded in a recording medium of low ink absorbability. In other words, the ink landed on a surface of the recording medium is irradiated with a short-wavelength ultraviolet ray to harden the surface, and then a long-wavelength ultraviolet ray is applied to harden the inside. Thus, blotting of the ink on the surface of the recording medium or color mixing such as mixing with an adjacent ink is prevented to enable acquisition of an extremely high-definition image.

However, when this method is applied to a recording medium having a high ink absorbability such as plain paper or fabric not treated for blotting prevention, so-called print through in which the ink soaks in the recording medium causing ink blotting or the ink to reach the backside of the recording medium may occur. Particularly, when a high-density image is formed, as the amount of ink putted in per unit area of the recording medium is increased, the ink blotting becomes more sever so as to increase a level of the print through.

According to the ink jet recording apparatus described in Japanese Patent Application Laid-Open No. Hei 6-200204, it is proposed that a thermally meltable ink containing wax, a resin and an ultraviolet curable resin having melting points at 40 to 70° C. is jetted to the recording medium, and the ink is hardened by applying ultraviolet rays while preventing ink blotting by the wax or the like.

According to these methods, however, ink blending, storage management, jet control or the like is complex and burdensome, and besides resistance to abrasion of the ink hardened on the recording medium, i.e., abrasion resistance, may be reduced to cause image quality deterioration.

SUMMARY

An object of the present invention is to provide an ink jet recording apparatus capable of preventing ink blotting or print through and improving abrasion resistance when images are recorded in a recording medium having an ink absorbability.

In order to accomplish the above object, according to one of aspects of the preferred embodiment of the present invention, an ink jet recording apparatus for recording images in a recording medium having an ink absorbability, includes: a recording head including a nozzle for jetting a photocurable ink onto the recording medium; and a light irradiation device to apply light to the photocurable ink landed on the recording medium, wherein: the light irradiation device includes a first light source to emit light having a first emission spectrum, and a second light source to emit light having a second emission spectrum whose peak wavelength is shorter than a peak wavelength of the first emission spectrum, and the first and second light sources are arranged so that the first light source irradiates the photocurable ink landed on the recording medium and thereafter the second light source irradiates the photocurable ink.

Preferably, the lights having the first and second emission spectrums are ultraviolet rays.

Preferably, the light having the second emission spectrum is an ultraviolet ray having a peak wavelength at 280 nm or less belonging to a short wavelength ultraviolet region.

Preferably, each of the first and second light sources includes an LED.

Preferably, the ink jet recording apparatus includes a plurality of the recording heads, wherein the first light source is disposed at least between each two adjacent recording heads.

Preferably, the second light source is disposed in a rear end side of the recording head in a moving direction relative to the recording medium.

BRIEF DESCRIPTION OF THE DRAWINGS

The present invention will become more fully understood from the detailed description given hereinbelow and the appended drawings, and thus are not intended as a definition of the limits of the present invention, and wherein.

DETAILED DESCRIPTION OF THE PREFERRED EMBODIMENT

An embodiment of an ink jet recording apparatus of the present invention will be described with reference to the attaching drawings.

Figure 1:
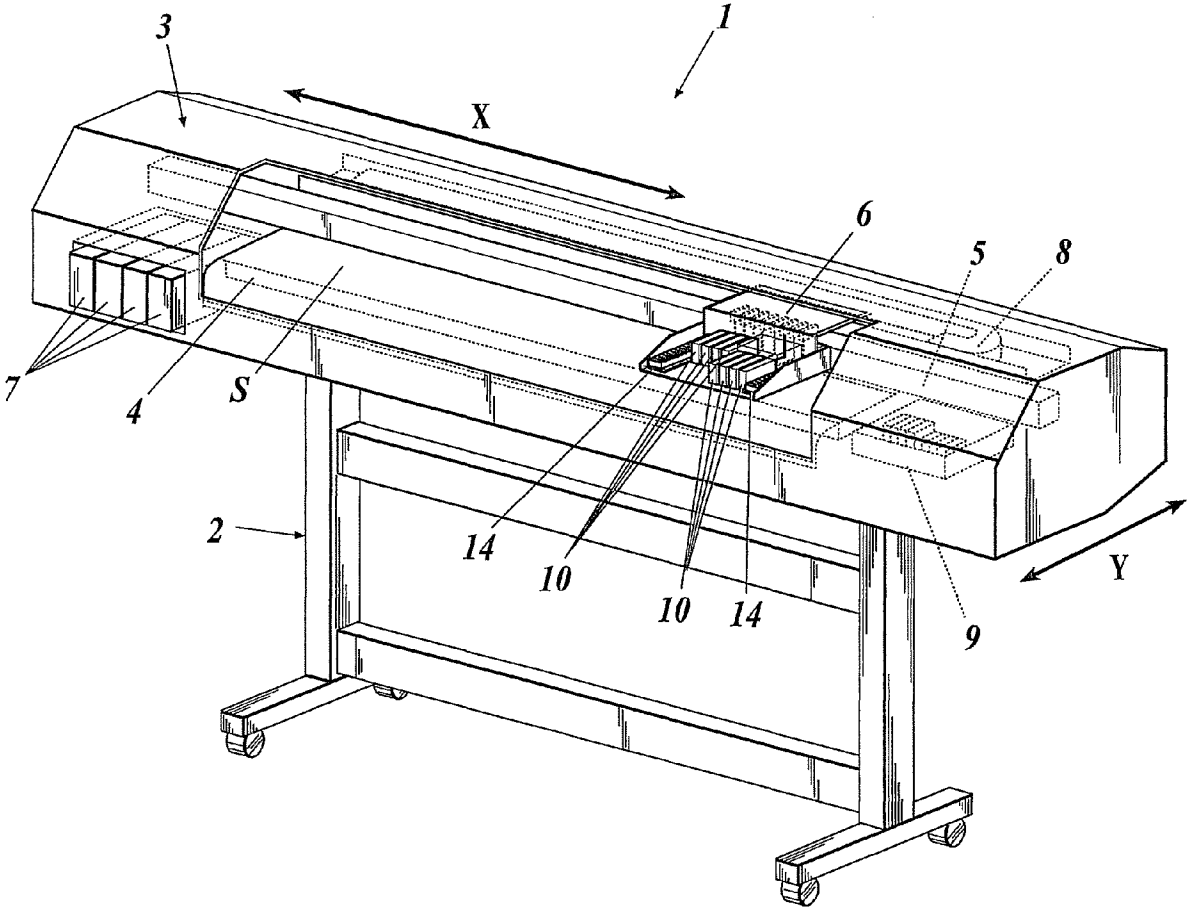
FIG. 1 is a perspective diagram showing an entire configuration of an ink jet recording apparatus according to an embodiment.

As shown in FIG. 1, an ink jet recording apparatus 1 of the embodiment includes a printer main body 3 supported in a support base 2. In the printer main body 3, a platen 4 of a flat plate shape is arranged roughly horizontally to support a recording medium S from a nonrecording side. On upstream and downstream sides of a subscanning direction of the platen 4 indicated by an arrow Y (shown), a convey roller and a driven roller (not shown) are arranged to convey the recording medium S in the subscanning direction Y.

The convey roller is driven to rotate intermittently by a predetermined amount by a convey motor (not shown). By rotation of this convey roller, the recording medium S is intermittently conveyed in the subscanning direction Y while repeating movements and stops. For example, a configuration can be employed in which an endless conveyor belt (not shown) is set between the convey roller and the driven roller, and the recording medium S is conveyed in a state of being mounted on the conveyor belt on an upper surface side of the platen 4.

For the recording medium S, a recording medium having ink absorbability is used. As recording media having an ink absorbability, for example, various pieces of paper such as plain paper, recycled paper, glossy paper, various fabrics, and fabrics such as unwoven fabric not treated for blotting prevention are available. A recording medium such as a resin film normally having no ink absorbability can be used in the invention as long as ink absorbability is provided.

A bar-shaped guide rail 5 is disposed above the platen 4, and a carriage 6 of a roughly casing shape is supported on the guide rail 5. This carriage 6 is reciprocated in a main scanning direction indicated by an arrow X (shown) along the guide rail 5 by a driving mechanism (not shown).

On one end side of the platen 4 in the main scanning direction X, an ink tank 7 is installed to store an ink of each color to be jetted from a recording head 10 described below. The ink is supplied from the ink tank 7 through a flexible tube 8 to the recording head 10. On the other end side of the platen 4 in the main scanning direction X, a maintenance unit 9 is installed to clean the recording head 10.

Figure 2:
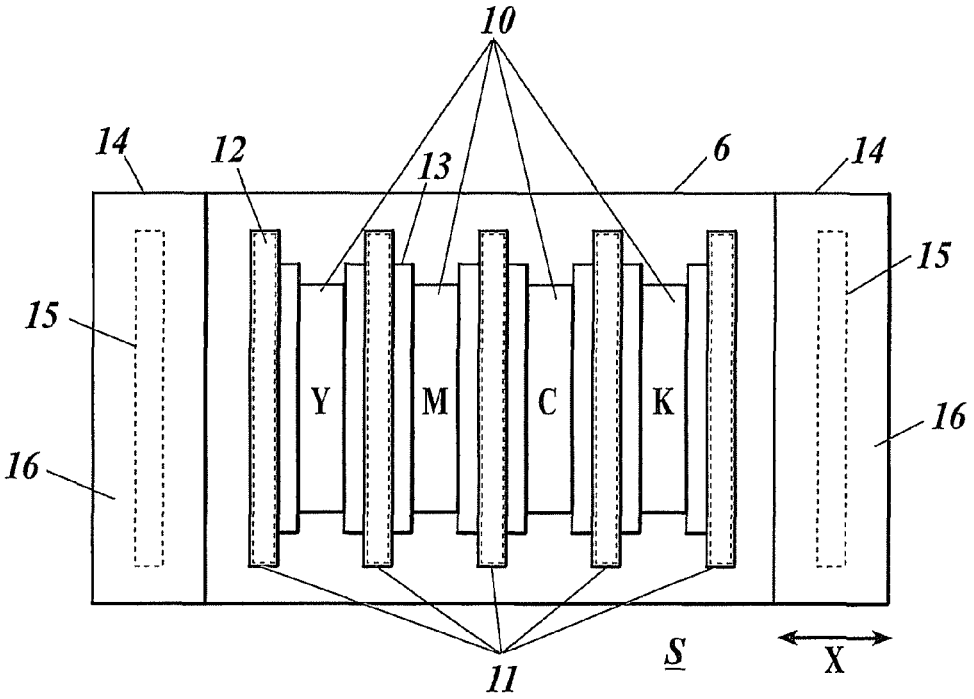
FIG. 2 is a schematic top view showing a configuration of a carriage section.
Figure 3:
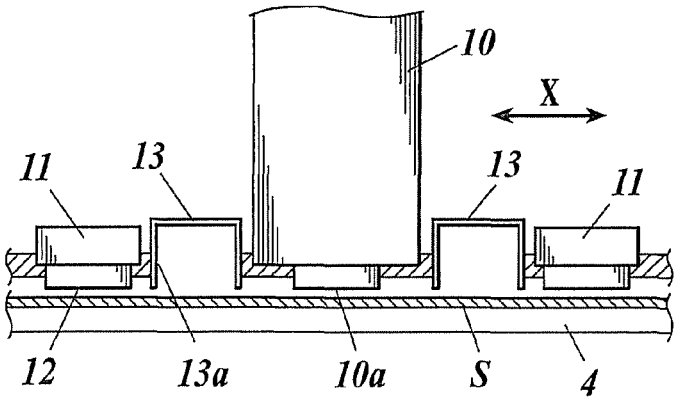
FIG. 3 is a partially side sectional view of the carriage section of FIG. 2.

As shown in a top view of FIG. 2 and a side sectional diagram of FIG. 3, a plurality of recording heads 10 are mounted on the carriage 6, and arranged in parallel in the main scanning direction X. Each recording head 10 scans above the recording medium S in association with the reciprocation of the carriage 6 along the guide rail 5 in the main scanning direction.

A nozzle surface 10*a* is formed in a bottom surface of each recording head 10. The recording head 10 is arranged so that the nozzle surface 10*a* penetrates the bottom surface of the carriage 6 so as to face the recording medium S or the platen 4. In the nozzle surface 10*a* of the recording head 10, a plurality of nozzles (not shown) are formed to jet the ink.

In the recording head 10, a piezoelectric element (not shown) is arranged corresponding to each nozzle. The piezoelectric element is deformed by an electrostriction effect according to an applied driving voltage, and an inside of an ink room formed behind the nozzle is pressurized to jet the ink from each nozzle. The piezoelectric element of the embodiment can adjust a level of deformation according to an applied driving voltage. By changing the applied driving voltage, the amount of ink jetted from the nozzle, i.e., the amount of droplets per drop of ink, can be changed.

For example, a heater element can be used in place of the piezoelectric element. In this case, by changing a driving voltage applied to the heater element, a growth rate of bubbles generated and grown by heating of the heater element can be changed to change the amount of ink jetted from the nozzle. Through use of a recording head of a so-called multidrop system as a recording head, the amount of ink jetted from the nozzle can be changed by changing the number of ink drops jetted from the nozzle.

According to the embodiment, each color ink is supplied to a corresponding recording head 10 from each ink tank 7 which stores each of color inks of yellow (Y), magenta (M), cyan (C), and black (K). Inks of the same color are jetted from the nozzles belonging to one recording head 10.

The ink used according to the embodiment is a photocurable ink hardened when irradiated with light. Especially, an ultraviolet curable ink hardened when irradiated with ultraviolet rays is preferably used. The photocurable ink includes main components of at least a polymerizable compound containing a well-known polymerizable compound, a photoinitiator, and a coloring material. For the coloring material, pigments are preferably used from the standpoint of weather resistance or the like. No photoinitiator may be used depending on an ink composition.

For the photocurable ink, a radical polymerization ink containing a radical polymerization compound as a polymerizable compound or a cationic polymerization ink containing a cationic polymerization compound is preferably used, or a hybrid type ink combining the radical polymerization ink and the cationic polymerization ink can be used. The cationic polymerization ink has excellent functionality and versatility because of a limited inhibition effect of polymerization reaction by oxygen or no inhibition effect.

Specifically, for example, the cationic polymerization ink of the embodiment is a mixture containing at least a cationic polymerization compound such as an oxetane compound, an epoxy compound or a vinyl ether compound, a photo cation initiator, and pigments, and having the nature of being hardened when irradiated with ultraviolet rays.

First light irradiation devices 11 are disposed among the plurality of recording heads 10 arranged in parallel on the carriage 6 in the main scanning direction X. According to the embodiment, the first light irradiation devices 11 are disposed not only among the recording heads 10 but also each outside of the recording heads 10 of both ends of the main scanning direction X.

According to the embodiment, each first light irradiation device 11 includes a first light source 12 to emit light having a first emission spectrum, and the first light source 12 includes an LED. The LED is advantageous in that lighting is instantaneous and a life is long. For the first light source 12, another component such as a high pressure mercury lamp, a metal halide lamp, a black light, a hot cathode tube, or a cold cathode tube which can emit ultraviolet rays can be used.

In place of the above, for the first light source 12, a light source to emit a visible light or infrared rays can be used as long as it can harden or thicken the ink landed on the recording medium therein.

According to the embodiment, a plurality of circular LEDs (not shown) are arrayed in line in a bottom surface of the first light irradiation device 11. As in the case of the nozzle surface of the recording head 10 described above, the LED is arranged to penetrate the bottom portion of the carriage 6, thereby facing the recording medium S. Light emitted from the LED is directly applied to the recording medium S.

A light trap 13 is disposed between each recording head 10 and each first light irradiation device 11. The light trap 13 is provided to prevent light emitted from the first light source 12 from being reflected on the recording medium S to reach the nozzle surface 10*a* of the recording head 10.

FIG. 3 shows a light trap 13 having U-shaped cross-section and opened toward the recording medium S. The light trap 13 is properly formed into a shape to effectively trap a reflected light. To effectively trap the reflected light, an inner surface 13*a* is properly processed such as coating of a light absorber for absorbing light on the inner surface 13*a* of the light trap 13.

A second light irradiation device 14 is disposed in a rear end side of the recording head 10 in a moving direction of the recording head 10 relative to the recording medium S, i.e., a rear end side of the main scanning direction of the recording head 10 moved above the recording medium S in the main scanning direction X. According to the embodiment, the recording head 10 jets inks in both cases of going and returning operations of the reciprocation in the main scanning direction X. Thus, rear end sides of the main scanning direction X are both end sides of the recording head 10 in the main scanning direction X, and second light irradiation devices 14 are disposed each outside of the first light irradiation device 11 disposed outside both ends of the recording head 10 in the main scanning direction X.

Each second light irradiation device 14 includes a second light source 15 to emit light having a second emission spectrum. According to the embodiment, the second light source 15 includes a low pressure mercury lamp. The low pressure mercury lamp has a peak wavelength of its emission spectrum in a wavelength area of 280 nm or less which is a so-called short wavelength ultraviolet region (UV-C area). The second light source 15 is preferably configured to emit an ultraviolet ray having a peak wavelength at 280 nm or less. Other than the low pressure mercury lamp, for example, an LED capable of emitting such ultraviolet rays can be used.

In each second light irradiation device 11, a reflection plate 16 having cross-section of a roughly semi-spindle shape in which the end of the recording medium S side is opened is arranged to surround the second light source 15. Light emitted from the second light source 15 is reflected on the reflection plate 16 to be applied to the recording medium S. When an LED is used for the second light source 15, arrangement is similar to that of the first light irradiation device 11 and the first light source 12.

A relation between the first and second light sources 12 and 15 respectively disposed in the first and second light irradiation devices 11 and 14 will be described.

Lights emitted from light sources normally have fixed wavelength distributions. In the case of the first and second light sources 12 and 14 used for the ink jet recording apparatus 1 of the present invention, a peak wavelength of an emission spectrum of the second light source 15 is set to be shorter than that of an emission spectrum of the first light source 12. When a light source to emit light of a single wavelength such as a laser beam is used, the single wavelength is equivalent to the peak wavelength.

As shown in Example described below, a difference in peak wavelength between the two light sources 12 and 15 is preferably 50 nm or more, more preferably 100 nm or more.

If the first and second light sources 12 and 15 both emit ultraviolet rays, easily handled well-known light sources can be used, and preferable as determination and adjustment of a corresponding composition of ink are easy. However, as described above, for the first light source 12 is required to emit light of a longer wavelength, a light source to emit a visible light or infrared rays can be used.

As shown in the Example described below, if the second light source 14 required to emit light of a shorter wavelength is a light source having a peak wavelength of an emission spectrum in a wavelength area of 280 nm or less which is a so-called short wavelength ultraviolet region as in the case of the embodiment, it is preferable because at least a surface of the ink on the recording medium S is surely hardened and ink abrasion resistance is increased.

Next, an operation of the ink jet recording apparatus 1 of the embodiment will be described.

The carriage 6 reciprocates above the recording medium S stopped on the platen 4 in the main scanning direction X during image recording. The recording head 10 scans on the recording medium S in association with the reciprocation of the carriage 6, and an ink is properly jetted from the nozzle to record an image of a predetermined width in the recording medium S.

Upon an end of one-direction scanning and recording of the recording head in the main scanning direction X, the convey roller rotates to convey the recording medium S by a predetermined amount on the platen 4 in the subscanning direction Y and then to stop the same. When the recording head 10 scans in a reverse direction of the main scanning direction X to record data, the convey roller conveys the recording medium S again by a predetermined amount in the subscanning direction Y to stop. Accordingly, the scanning of the recording head 10 in the main scanning direction X and the intermittent conveying of the recording medium S by the convey roller in the subscanning direction Y are associated with each other to record a predetermined image in the recording medium S.

In this case, when an ink is jetted from the nozzle of the recording head 10 to the stopped recording medium S, the ink landed on the recording medium S starts to permeate the recording medium S by ink absorbability of the recording medium S.

When the scanning of the recording head 10 in the main scanning direction X, i.e., the movement of the carriage 6 in the main scanning direction X, is accompanied by the movement of the first light irradiation device 11 above the ink landed on the recording medium S, the ink is irradiated with light from the first light source 12 of the first light irradiation device 11.

At this stage, the light emitted from the first light source 12 is light having a peak wavelength on a long wavelength side and containing many long-wavelength components. Accordingly, the long-wavelength components of the light reach the inside of the ink to large extent without being affected so much by scattering caused by pigments of the ink, thereby hardening or thickening the ink from the inside. Thus, the ink started to permeate the recording medium S stops spreading in a surface or thickness direction of the recording medium S.

Further movement of the carriage 6 in the main scanning direction X is accompanied by movement of the second light irradiation device 14 above the ink landed on the recording medium S. The ink is irradiated with light from the second light source 15 of the second light irradiation device 14.

At this stage, the light emitted from the second light source 15 is light having a peak wavelength on a short wavelength side and containing many short wavelength components. Accordingly, the short wavelength components of the light are emitted in large quantity to harden the surface of the ink. Long wavelength components contained in the light reach the inside of the ink to harden the ink from the inside.

As described above, according to the ink jet recording apparatus 1 of the embodiment, first, the light having a peak wavelength on the long wavelength side is applied to the ink landed on the recording medium S having an ink absorbability to surely reach the inside of the ink, and the ink is hardened or thickened from the inside so that the ink started to permeate the recording medium S can stop spreading in the surface or thickness direction of the recording medium S.

As a result, blocking of spreading of the ink in the surface direction of the recording medium S enables sure prevention of blotting of the ink, and effective prevention of color mixing with an adjacent ink. Moreover, blocking of spreading of the ink in the thickness direction of the recording medium S enables sure prevention of print through of the ink. Thus, a high-definition and high-quality image having no ink blotting, print through or color mixing can be obtained.

By subsequently applying the light having a peak wavelength on the short wavelength side, the ink is hardened more, and its surface is surely hardened. Thus, resistance to ink abrasion, i.e., ink abrasion resistance, can be increased, and a high-quality image having strong resistance to abrasion can be obtained.

According to the embodiment, by disposing the first light source 12 between the recording heads 10, the ink landed on the recording medium S can surely receive the light from the first light source 12 before the light from the second light source 15. Moreover, with this configuration, a distance between the nozzle of the recording head 10 and the first light source 12 can be designed to be constant among the recording heads 10. Thus, levels of ink spreading on the recording medium S can be set equal among all the recording heads 10, and a higher quality image can be obtained.

Incidentally, in the present invention, the ink landed on the recording medium S is fist blocked from spreading by the first light irradiation device 11, and then more hardening of the ink and hardening of its surface are simultaneously carried out by the second light irradiation device 14. However, this configuration is in no way limitative of the invention. Any configuration can be employed as long as light is emitted from the second light source 15 after light is emitted from the first light source 12.

For example, as shown in FIG. 14, a configuration can be employed in which a light irradiation device 17 serving both as first and second light irradiation device 11 and 14 is disposed in the position of the first light irradiation device 11 of the embodiment, first light sources 12 are disposed in parallel in both end sides of the light irradiation device 17 in its main scanning direction X, a second light source 15 is arranged between the first light sources 12, and a carriage portion of the ink jet recording apparatus is configured not to dispose any second light irradiation devices 14 in both end sides of the carriage 6 in the main scanning direction different from the case of the embodiment. In above configuration, an operation is the same as that of the embodiment, and similar effects can be obtained.

The embodiment has been described as example of the ink jet recording apparatus 1 of a serial head type. However, the embodiment can similarly be applied to an ink jet recording apparatus 20 of a line head type.

Figure 5:
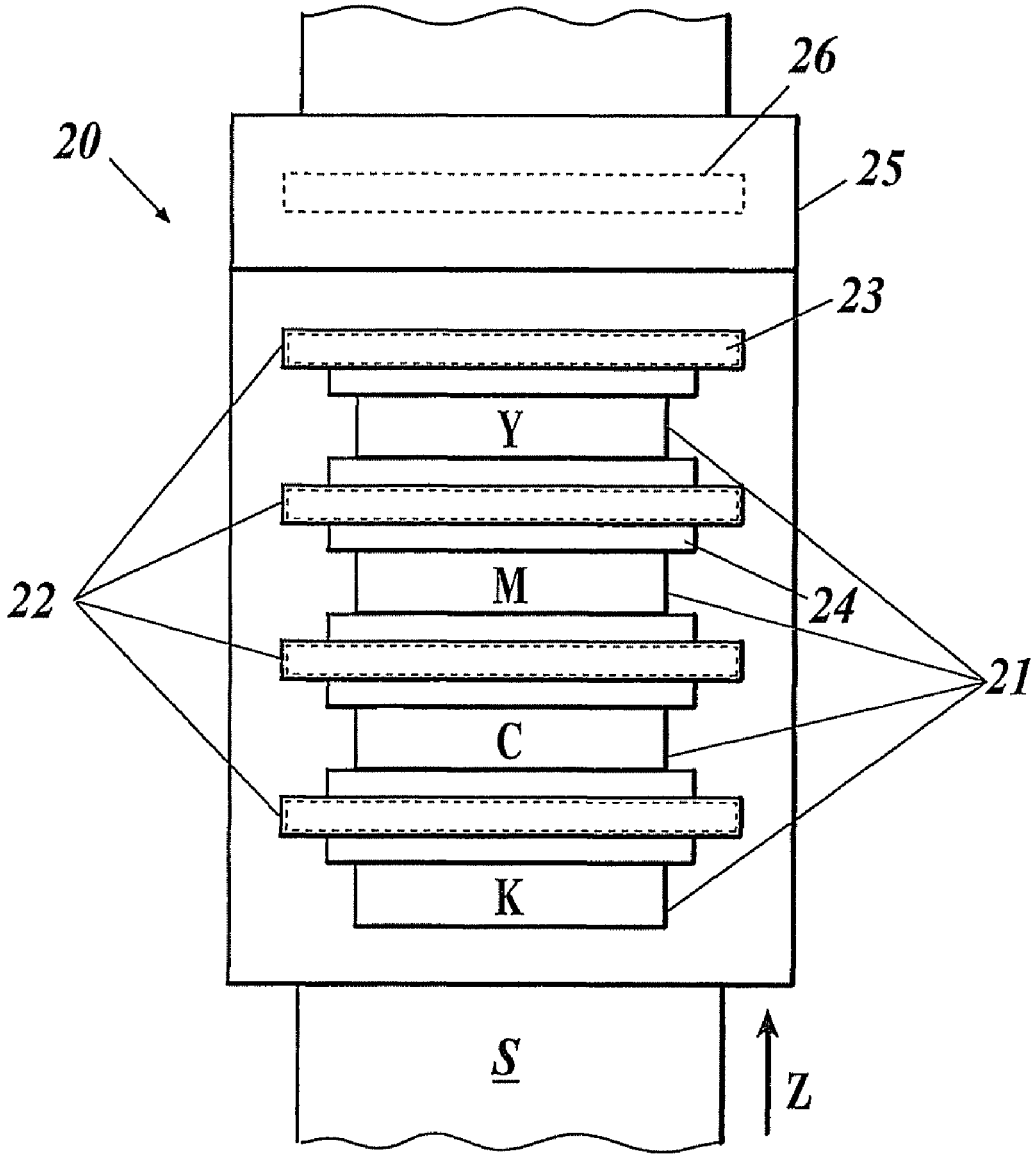
FIG. 5 is a schematic top view showing a carriage section in a line head type ink jet recording apparatus.

For example, as shown in FIG. 5, in the ink jet recording apparatus 20 of the line head type, above a recording medium S supported on a platen (not shown) from a nonrecording surface side, a plurality of recording heads 21 for color inks of, for example, yellow (Y), magenta (M), cyan (C) and black (k), are arranged in parallel in a conveying direction Z of the recording medium S indicated by an arrow Y (shown). In this case, a material of the recording medium S, ink types, and the like are similar to those of the embodiment.

A first light irradiation device 22 including a first light source 23 to emit light having an emission spectrum of a relatively long peak wavelength is arranged between each of the recording heads 21, and a light trap 24 is disposed between the recording head 21 and the first light irradiation device 22.

A second light irradiation device 25 is arranged on a rear end side of the recording head 21 in a moving direction relative to the recording medium S, i.e., a most downstream side in the conveying direction Z of the recording medium S when seen from a static system of the recording head 21. The second light irradiation device 25 includes a second light source 26 to emit light having a second emission spectrum of a relatively short peak wavelength.

A relation between the lights respectively emitted from the first and second light sources 23 and 26 of the first and second light irradiation devices 22 and 25 is similar to that of the embodiment.

With this configuration, as in the case of the ink jet recording apparatus 1 of the serial head type of the embodiment, in the ink jet recording apparatus 20 of the line head type, light having a peak wavelength on a long wavelength side is first emitted to an ink landed on the recording medium S having an ink absorbability to harden or thicken the ink from the inside, and then light having a peak wavelength on a shorter wavelength side is emitted to harden the ink more, thereby surely hardening its surface.

Thus, spreading of the ink started to permeate the recording medium S in a surface or thickness direction of the recording medium S is stopped by the long wavelength light to surely prevent ink blotting, color mixing or print through, and the surface of the ink is hardened more surely to enable a sure increase of ink abrasion resistance. As a result, a high-definition and high-quality image having high abrasion resistance can be obtained.

Figure 4:
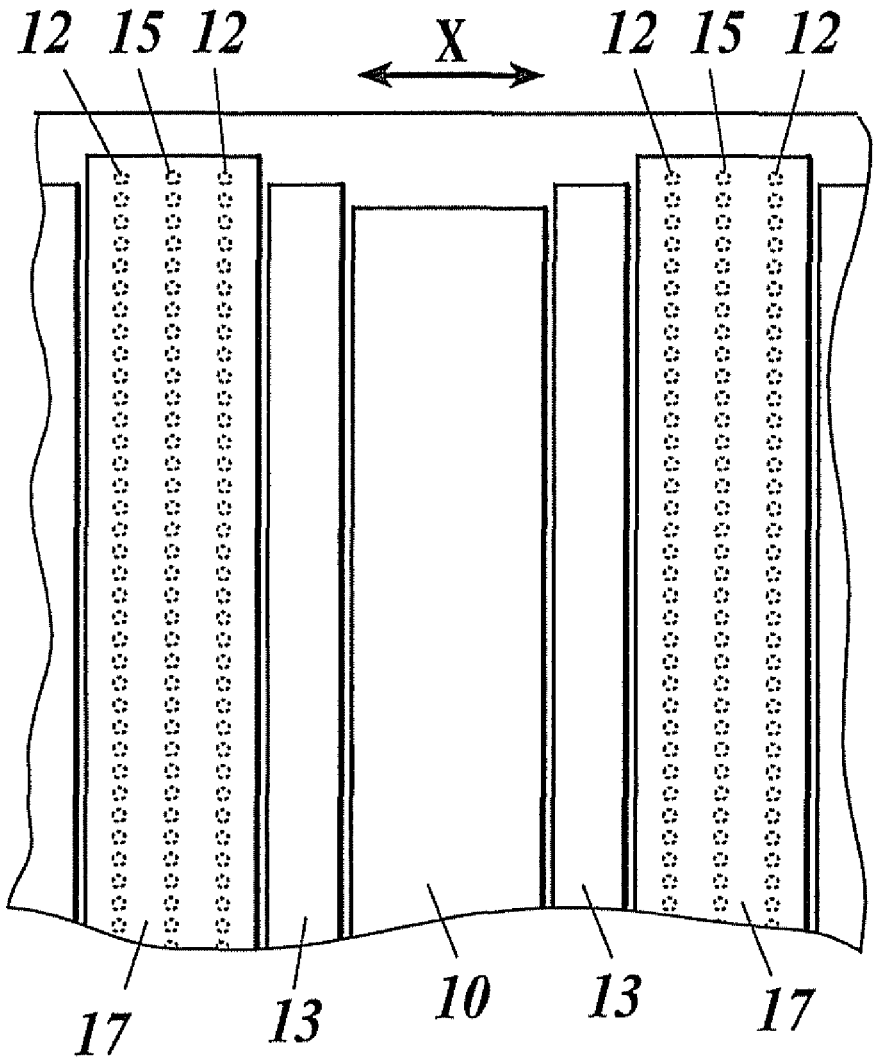
FIG. 4 is a schematic top view showing a carriage section according to a modified example of a light irradiation device.

The modified light irradiation device shown in FIG. 4 in the ink jet recording apparatus 1 of the serial head type can be applied to the ink jet recording apparatus 20 of the line head type. In both of the serial and line head types, recording heads for jetting the same type of ink can be configured by combining a plurality of recording heads. The recording head, the light irradiation device, the light trap, and the like can be modified within the scope of the present invention.

According to this ink jet recording apparatus, first, light having a peak wavelength on a long wavelength side which is not to be scattered easily by pigments of the ink is applied to the ink landed on the recording medium having an ink absorbability. The light surely reaches the inside of the ink to harden or thicken the ink from the inside, whereby spreading of the ink started to permeate the recording medium in the surface or thickness direction of the recording medium is surely stopped.

Thus, blocking of spreading of the ink in the surface direction of the recording medium enables sure prevention of ink blotting, and effective prevention of color mixing with an adjacent ink. Moreover, blocking of spreading of the ink in the thickness direction of the recording medium enables ink print through. As a result, a high-definition and high-quality image having no ink blotting, print through or color mixing can be obtained.

By subsequently applying light having a peak wavelength on a short wavelength side, the ink is hardened more and its surface is surely hardened. Thus, resistance to ink abrasion, i.e., abrasion resistance, can be increased, and a high-quality image of high abrasion resistance can be obtained.

Preferably, in the ink jet recording apparatus, the lights having the first and second emission spectrums are ultraviolet rays.

According to this ink jet recording apparatus wherein the first and second light sources are both light sources to emit ultraviolet rays, easily handled well-known light sources can be used, facilitating deciding and adjusting of a corresponding ink composition.

Preferably, in the ink jet recording apparatus, the light having the second emission spectrum is an ultraviolet ray whose peak wavelength is 280 nm or less and belongs to a short wavelength ultraviolet region.

According to this ink jet recording apparatus, the ultraviolet ray having a peak wavelength at 280 nm or less belonging to so-called short wavelength ultraviolet region (UV-C area) is emitted from the second light source to the ink. Thus, the surface of the ink on the recording medium is surely hardened, and ink abrasion resistance is greatly improved, exhibiting effects of the invention more accurately.

Preferably, in the ink jet recording apparatus, each of the first and second light sources includes a light emitting diode (LED).

According to this ink jet recording apparatus, different from a high-pressure mercury lamp or a low-pressure mercury lamp, the LED has an advantage that lighting is instantaneous and a life is long. Thus, by using the LED for each of the first and second light sources, the necessity of time for warming-up the light sources is eliminated to increase operation efficiency of the ink jet recording apparatus. As the light sources are used long, running costs of the apparatus can be reduced.

Preferably, the ink jet recording apparatus includes a plurality of the recording heads, and the first light source is disposed at least between each two adjacent recording heads.

According to this ink jet recording apparatus, whichever of a serial head type and a line head type the ink jet recording apparatus is, the ink landed on the recording medium can surely receive the light from the first light source before it receives the light from the second light source, thereby exhibiting effects of the invention more surely.

With this configuration, a distance between the nozzle of the recording head and the first light source can be designed constant for the recording heads. Thus, levels of ink spreading on the recording medium can be set equal among all the recording heads, enabling acquisition of a higher-quality image.

Preferably, in the ink jet recording apparatus, the second light source is disposed in the rear end side of the recording head in a moving direction relative to the recording medium.

According to this ink jet recording apparatus, by disposing the second light source in the rear end side of the recording head in the moving direction relative to the recording medium, the ink landed on the recording medium lastly receives the light from the second light source after it receives the light from the first light source, thereby exhibiting effects of the invention more surely.

EXAMPLE

Experiment Contents

By using the ink jet recording apparatus 1 of the serial type, an experiment was performed to investigate ink blotting, print through or abrasion resistance on the recording medium S when a combination of the first and second light sources 12 and 15 were widely varied, and peak wavelengths or emission spectra of lights emitted from the light sources were changed.

Experiment Conditions

For the light sources, three types of light sources were used. Specifically, an LED to emit light having an emission spectrum of a peak wavelength at about 365 nm and a half-value width of about 10 nm was used as a light source A, an excimer lamp to emit light having an emission spectrum of a peak wavelength at about 308 nm was used as a light source B, and a low-pressure mercury lamp having a strong emission spectrum at about 254 nm was used as a light source C.

Copying plain paper not subjected to any special treatment was used for the recording medium S, and normal cationic polymerization ultraviolet curable ink of black (k) having main sensitivity around 254 nm was used for the ink.

Result

Table 1 shows an experiment result. In Table 1, for example, "A→B" indicates a case in which the light source A is used as the first light source 12 and the light source B is used as the second light source 15. In evaluation in Table 1, ink hardening levels are determined as follows based on viewing and touching sense of inks recorded in the recording medium S:

I: very good
II: good or within a practical range
III: bad or not practical

TABLE 1

| | Light source | Ink blotting Print through | Abration resistance |
|---|---|---|---|
| Comparative Example 1 | A → A | I | III |
| Example 1 | A → B | I | II |
| Example 2 | A → C | I | I |
| Comparative Example 2 | B → A | II | III |
| Comparative Example 3 | B → B | II | II |
| Example 3 | B → C | II | I |
| Comparative Example 4 | C → A | III | II |
| Comparative Example 5 | C → B | III | II |
| Comparative Example 6 | C → C | III | II |

Evaluation

As apparent from the results of Comparative Example 1 and Examples 1 and 2 of Table 1, when the light source A emitting light having an emission spectrum of a peak wavelength at about 365 nm and a half value width of about 10 nm is used as the first light source 12, a very good result of no ink blotting or print through can be obtained. As apparent from Comparative Examples 2 and 3 and Example 3, when the light source B emitting light having an emission spectrum of a peak wavelength at about 308 nm is used as the first light source 12, a good result of no ink blotting or setting-off is obtained.

On the other hand, as apparent from Comparative Examples 4 to 6, when the light source C is used as the first light source 12, in other words, a low-pressure mercury lamp having a strong emission spectrum at about 254 nm is used, a result is not favorable as ink blotting or print through occurs.

Figure 6A:
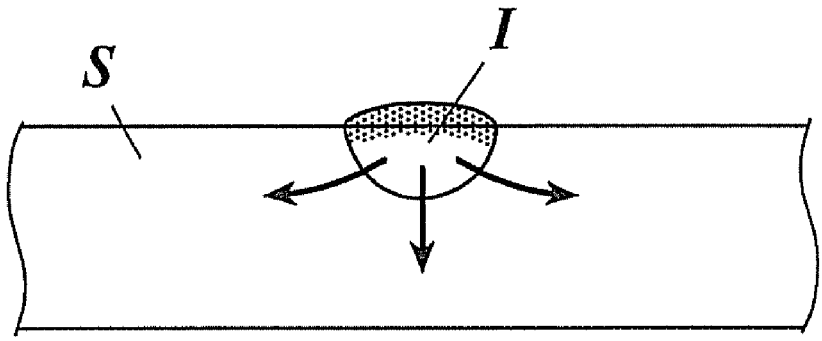
FIG. 6A is a diagram showing hardening of an ink landed on a recording medium when light of a short wavelength is applied.
Figure 6B:
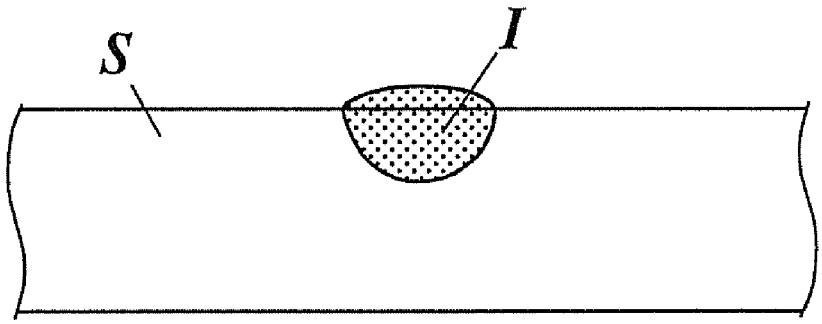
FIG. 6B is a diagram showing hardening of an ink landed on the recording medium when light of a longer wavelength is applied.

If the light first emitted from the first light source 12 to the ink landed on the recording medium S is a short wavelength light, as shown in FIG. 6A, while a surface of ink I is hardened, the inside of the ink I is not sufficiently hardened, resulting in permeation of an unhardened ink through the recording medium S. However, if the light emitted from the first light source 12 is a long wavelength light, as shown in FIG. 6B, the light reaches the inside of the ink I to accurately harden or thicken the ink I from the inside.

Regarding ink abrasion resistance, a very good result is obtained when the short wavelength light source C is used as the second light source 15, and a good result is generally obtained when the light source B is used. Thus, for the second light source 15, a light source having a peak wavelength of an emission spectrum in a wavelength area of 280 nm or less which is a so-called short wavelength ultraviolet region is preferably used. It is more preferable if a peak wavelength is 254 nm or less as in the case of the light source C.

As can be understood from results of Examples 1 to 3 of Table 1, when the longer wavelength light is emitted from the first light source 12 to the ink I landed on the recording medium S, and then the shorter wavelength light is emitted from the second light source 15, a result of less ink blotting or print through and high abrasion resistance is obtained.

When an experiment is performed by fixing the second light source 15 to the light source C having a strong emission spectrum at about 254 nm, and variously replacing light sources used for the first light source 12, a very good result is obtained in the case where the light source A having a peak wavelength at about 365 nm is used for the first light source 12 as shown in Example 2 of Table 1, and a good result is obtained in the case where the light source B having a peak wavelength at about 308 nm is used for the first light source 12 as shown in Example 3 of Table 1.

It can therefore be understood that a preferable difference in peak wavelength between the first and second light sources 12 and 15 is 50 nm or more at the lowest, and 100 nm or more is more preferable.

In the case other than the aforementioned experiment conditions, in other words, if fabric is used for the recording medium S, or other types of inks different in main sensitivity are used, or if the ink jet recording apparatus 20 of the line head type is used, almost similar results can be obtained.

All of the disclosures including the patent specification, the claims, the attached drawings and the abstract of Japanese Patent Application No. 2006-254394 filed Sep. 20, 2006 are herein incorporated by reference.

What is claimed is:

1. An ink jet recording apparatus for recording images in a recording medium having an ink absorbability, comprising:

a plurality of recording heads arranged in a scanning direction on a carriage structured to reciprocate in the scanning direction, each of the plurality of recording heads including a nozzle for jetting a photocurable ink onto the recording medium;

a first light source structured to emit light having a first emission spectrum; and at least two second light sources each structured to emit light having a second emission spectrum whose peak wavelength is shorter than a peak wavelength of the first emission spectrum;

wherein the first light source is disposed between two adjacent recording heads among the plurality of recording heads in the scanning direction;

a first one of the at least two second light sources is provided at a first end of the carriage in the scanning direction, and a second one of the at least two second light sources is provided at a second end of the carriage in the scanning direction, such that the plurality of recording heads are provided between the first one of the at least two light sources and the second one of the at least two second light sources in the scanning direction, so that the first light source irradiates the photocurable ink landed on the recording medium and thereafter at least one of the at least two second light sources irradiates the photocurable ink.

2. The ink jet recording apparatus of claim 1, wherein the lights having the first and second emission spectrums are ultraviolet rays.

3. The ink jet recording apparatus of claim 1, wherein the light having the second emission spectrum is an ultraviolet ray having a peak wavelength at 280 nm or less belonging to a short wavelength ultraviolet region.

4. The ink jet recording apparatus of claim 1, wherein each of the first and second light sources includes an LED.

* * * * *